US008096356B2

(12) United States Patent
Guignard et al.

(10) Patent No.: US 8,096,356 B2
(45) Date of Patent: Jan. 17, 2012

(54) SYSTEM AND METHOD FOR PREVENTING BUCKLING DURING A GRAVEL PACKING OPERATION

(75) Inventors: Thibaut Guignard, Houston, TX (US); Jeremie Poizat, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 251 days.

(21) Appl. No.: 12/020,117

(22) Filed: Jan. 25, 2008

(65) Prior Publication Data

US 2009/0188674 A1 Jul. 30, 2009

(51) Int. Cl.
*E21B 43/04* (2006.01)

(52) U.S. Cl. ..... 166/278; 166/51

(58) Field of Classification Search ..... 166/114, 166/115, 116, 278, 51
See application file for complete search history.

(56) References Cited

U.S. PATENT DOCUMENTS

| | | | | |
|---|---|---|---|---|
| 2,644,532 | A * | 7/1953 | Mater | 166/312 |
| 3,062,284 | A * | 11/1962 | Brown | 166/278 |
| 4,401,158 | A | 8/1983 | Spencer | |
| 5,577,559 | A | 11/1996 | Voll | |
| 5,579,844 | A | 12/1996 | Rebardi | |
| 5,609,204 | A | 3/1997 | Rebardi | |
| 5,845,712 | A * | 12/1998 | Griffith, Jr. | 166/278 |
| 5,865,251 | A | 2/1999 | Rebardi | |
| 5,921,318 | A | 7/1999 | Ross | |
| 5,988,285 | A | 11/1999 | Tucker | |
| 6,311,772 | B1 * | 11/2001 | Myhre et al. | 166/278 |
| 6,405,800 | B1 | 6/2002 | Walker | |
| 6,408,942 | B2 * | 6/2002 | Martin | 166/278 |
| 6,446,729 | B1 | 9/2002 | Bixenman | |
| 6,464,006 | B2 | 10/2002 | Womble | |
| 6,464,261 | B1 | 10/2002 | Dybevik | |
| 6,488,082 | B2 | 12/2002 | Echols | |
| 6,494,260 | B2 * | 12/2002 | van Petegem et al. | 166/278 |
| 6,722,440 | B2 | 4/2004 | Turner | |
| 6,782,948 | B2 * | 8/2004 | Echols et al. | 166/278 |
| 6,932,156 | B2 | 8/2005 | Bayne | |
| 7,066,264 | B2 | 6/2006 | Bissonnette | |
| 2003/0047311 | A1 | 3/2003 | Echols | |

FOREIGN PATENT DOCUMENTS

| | | |
|---|---|---|
| WO | 0142620 | 6/2001 |

* cited by examiner

*Primary Examiner* — David Bagnell
*Assistant Examiner* — Robert E Fuller
(74) *Attorney, Agent, or Firm* — David G. Matthews; Rodney Warfford; Robert Van Someren

(57) ABSTRACT

A technique prevents buckling of a service tool assembly during a sand control operation in a wellbore. A completion assembly and a service tool assembly are positioned in a wellbore. An anti-buckling mechanism is positioned to limit the buckling load effects that can otherwise be experienced by the service tool assembly during the sand control operation.

20 Claims, 7 Drawing Sheets

SYSTEM AND METHOD FOR PREVENTING BUCKLING DURING A GRAVEL PACKING OPERATION

BACKGROUND

Many types of completions are used in sand control operations. Generally, a completion assembly is positioned in a wellbore and a service tool is used in cooperation with the completion assembly to create a gravel pack in the annulus around the completion assembly. The gravel pack helps filter out sand and other particulates from a desired production fluid entering the wellbore.

The gravel pack is formed by flowing a gravel slurry downhole to the well zone to be treated. At the well zone, a carrier fluid is separated from the gravel slurry leaving gravel to form the gravel pack. The carrier fluid reenters the completion assembly through a screen and is returned upwardly through a washpipe section of the service tool. The return flow is directed upwardly through a central passage of the washpipe and then diverted outwardly to an annular flow path through a crossover port.

In some applications, the service tool assembly is used to treat multiple zones in a single trip downhole. The service tool assembly is deployed into the wellbore while constrained within a completion assembly. As the completion assembly is anchored in the wellbore and the service tool assembly is moved to treat upper zones, the service tool assembly becomes exposed to the full casing diameter which is substantially larger than the outside diameter of the service tool assembly. When weight is applied from the surface onto the service tool assembly to maintain its position, severe buckling loads can be experienced at the service tool assembly. Additionally, buckling loads can occur during pumping operations while gravel packing one or more well zones.

SUMMARY

In general, the present invention provides a system and method for preventing buckling of a service tool assembly during a well treatment operation in a wellbore. A completion assembly and a service tool assembly are positioned in a wellbore. The completion assembly and the service tool assembly may be combined for deployment downhole. An anti-buckling mechanism is positioned to limit the buckling load effects that can otherwise be experienced by the service tool assembly during the well treatment operation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a well system that can be used for well treatment operations, such as sand control operations. The system and methodology provide a technique that can be used for forming a gravel pack at one or more well zones along a wellbore. A completion assembly and a service tool assembly are positioned in a wellbore. An anti-buckling mechanism is used to prevent buckling of the service tool assembly during various stages of the gravel packing operation. In treating multi-zone wells, the anti-buckling mechanism is able to limit the buckling load effects that can otherwise be experienced by the service tool assembly as the service tool assembly is initially positioned in the wellbore and subsequently operated in multiple well zones. However, the system and methodology are not limited to multi-zone, single trip sand control applications and also can apply to either open hole or cased hole environments.

By way of example, the anti-buckling mechanism may comprise a releasable anchor positioned to prevent buckling loads from reaching the service tool assembly. For example, the releasable anchor may be mounted proximate the top of the service tool assembly. In another embodiment, the anti-buckling mechanism comprises a support string that may be retrievable. The support string is deployed with the completion assembly and the service tool assembly to improve the buckling prevention capability of the service tool assembly.

In many sand control applications, set down positioning has become the standard approach for keeping the service tool assembly properly located inside the completion assembly throughout the gravel packing operation. Temperature and hydraulic effects can be major contributors to service tool assembly movement downhole. In many applications, e.g. multi-zone, single trip sand control applications, significant hydraulic loading occurs at the crossover between the conveyance, e.g. work string or drill pipe, and the internal service tool assembly components. The use of the anti-buckling mechanism enables weight to be "set down" for controlling the position of the service tool assembly while preventing buckling loads from detrimentally affecting the service tool assembly. As a result, the service tool assembly position is indicated at, for example, the bottom inside of the completion assembly, but the weight applied does not induce or threaten buckling of the service tool assembly.

Figure 1:
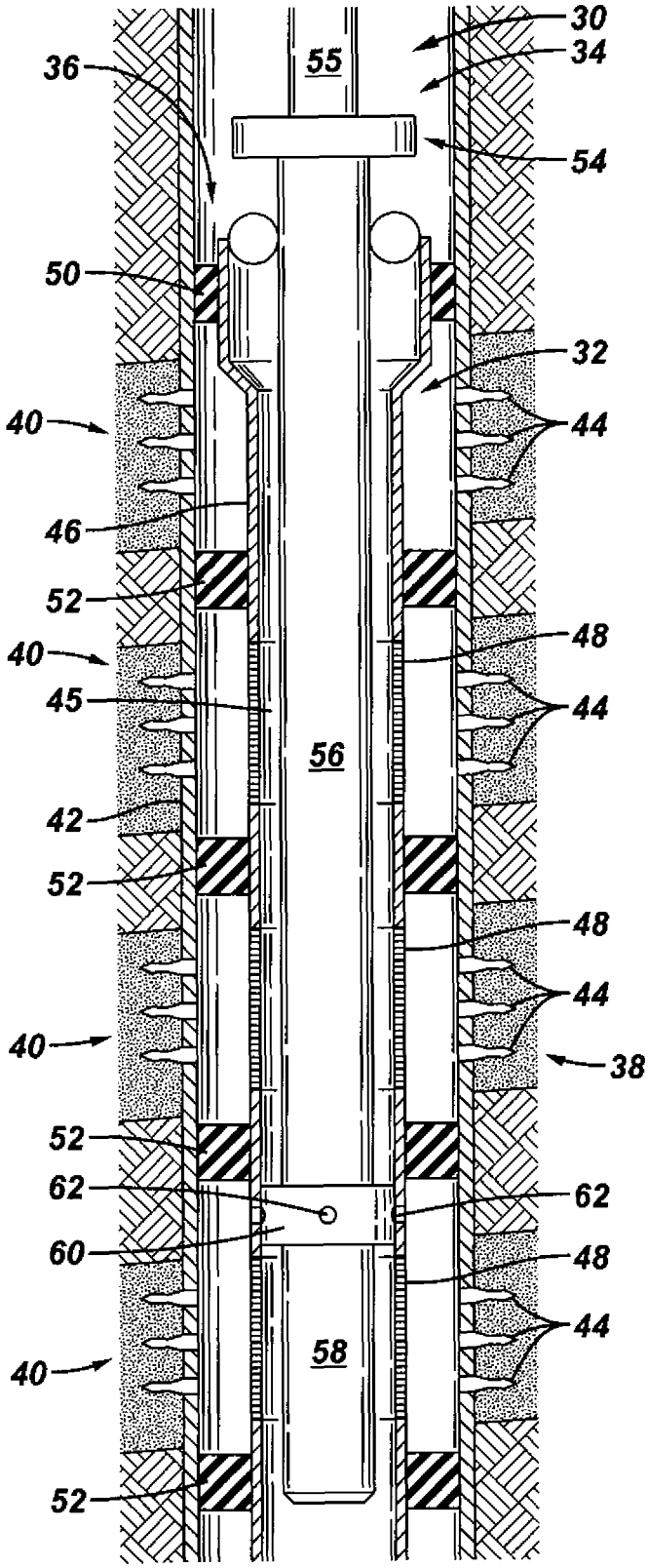
FIG. 1 is a front elevation view of a completion assembly and service tool deployed in a wellbore, according to an embodiment of the present invention.

Referring generally to FIG. 1, one embodiment of an anti-buckling well system 30 is illustrated. In this embodiment, well system 30 comprises a completion assembly 32 and a service string assembly 34 deployed in a wellbore 36. The wellbore 36 is drilled into a subsurface formation 38 having one or more well zones 40 that may contain desirable production fluids, such as petroleum. In the example illustrated, wellbore 36 is lined with a casing 42. The casing 42 typically is perforated in a manner that places perforations 44 along each well zone 40. The perforations 44 enable flow of fluids into (or out of) wellbore 36 at each well zone 40. Although the present completion assembly and service tool assembly are illustrated as utilized in a multi-zone, single trip application, the assemblies also are amenable to use in single zone applications.

In the embodiment illustrated, completion assembly 32 has an internal passage 45 defined within a tubular structure 46. Tubular structure 46 comprises screen assemblies 48 positioned at each well zone 40 to allow fluid flow therethrough. For example, each screen assembly 48 may allow the inward flow of returning carrier fluid during gravel packing at the corresponding well zone. The returning carrier fluid flows from the annulus surrounding the completion assembly 32 into the region between tubular structure 46 and service tool assembly 34 at the subject treatment zone. A packer 50, such as a GP packer, secures completion assembly 32 to wellbore casing 42. Additionally, a plurality of isolation packers 52 can be positioned between completion assembly 32 and the surrounding casing 42 at predetermined locations to selectively isolate the well zones 40.

Service tool assembly 34 may be deployed downhole with an anti-buckling mechanism 54 while engaged with completion assembly 32. An appropriate conveyance 55, such as a drill string, work string or other tubing, can be used to convey the completion assembly and the service tool assembly downhole in a single trip. The service tool assembly 34 may be attached to completion assembly 32 proximate the upper packer 50 by a suitable interface. Generally, service tool assembly 34 comprises an upper section 56 coupled to a service tool 58 through a crossover 60. Crossover 60 comprises one or more crossover ports 62 that are positioned adjacent corresponding circulating ports of completion assembly 32 to enable the flow of treatment fluid into the annulus surrounding completion assembly 32. In a gravel packing operation, a gravel slurry is pumped down into this annulus at a given well zone, and the carrier or return fluid portion of the slurry is returned up through service tool assembly 34.

The anti-buckling mechanism 54 prevents buckling of the service tool assembly 34 when setting weight down on the service tool assembly 34 and during various pumping procedures that may occur during the gravel packing operation. In the embodiment illustrated in FIGS. 2 and 3, for example, anti-buckling mechanism 54 is designed to prevent the transmission of buckling loads to the service tool assembly components. In this example, anti-buckling mechanism 54 comprises a releasable mechanical anchor 64 which may be repeatedly and selectively actuated between a disengaged and an engaged position.

Figure 2:
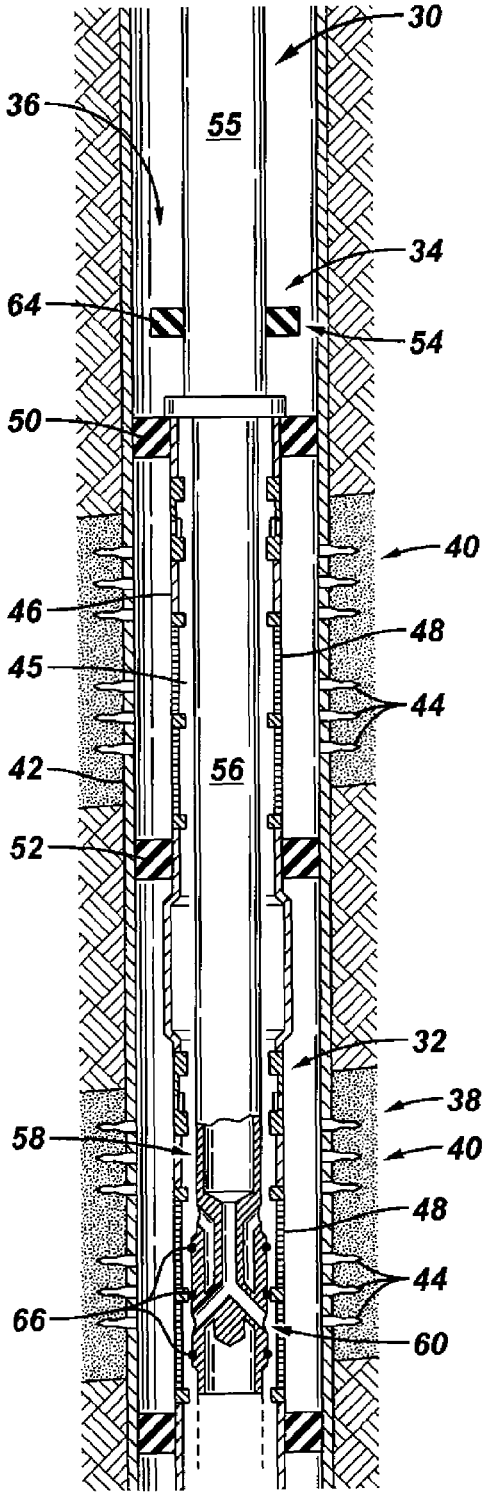
FIG. 2 is a schematic illustration of a service tool assembly and a completion assembly deployed in a wellbore with an anti-buckling mechanism, according to an embodiment of the present invention.

In FIG. 2, for example, completion assembly 32 and service tool assembly 34 are combined for movement downhole into wellbore 36, and a releasable mechanical anchor 64 is transported in the disengaged position to allow movement of service tool assembly 34 along the wellbore. It should be noted that releasable mechanical anchor 64 can be used with a variety of service tool assemblies. In the illustrated example, service tool assembly 34 comprises service tool 58 and crossover 60 along with other components, e.g. a reversing valve and a position indicator. Additionally, the service tool 58 may comprise various seal members 66 positioned to form desired seals with completion assembly 32 as required for various procedures conducted during the gravel packing operation. For example, seal members 66 and the other components of service tool 58 enable the selective flow of gravel slurry and placement of the surrounding gravel pack while also enabling reverse flow of fluid to reverse out excess slurry after gravel packing a particular well zone.

Figure 3:
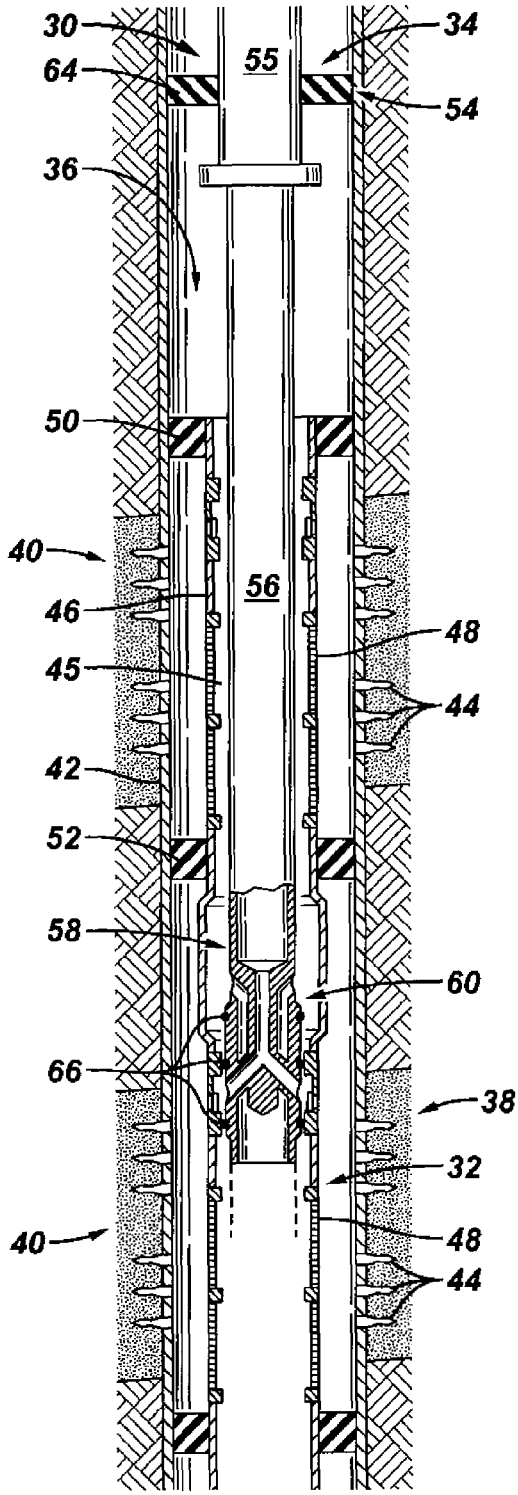
FIG. 3 is a schematic illustration similar to that of FIG. 2 but in a different operational configuration, according to an embodiment of the present invention.

Once completion assembly 32 is moved into the desired position, packer 50 is set and the completion assembly is anchored in the wellbore. At this stage, the service tool assembly 34 is released from the completion assembly and moved uphole, for example, to treat the one or more well zones. The release and movement uphole exposes the relatively small diameter service tool assembly 34 to potential buckling loads from various procedures that occur during the gravel packing operation. Accordingly, releasable mechanical anchor 64 is actuated to its engaged position, as illustrated in FIG. 3.

In the embodiment illustrated, releasable mechanical anchor 64 is set or engaged at a position selected to prevent detrimental buckling loads from being transferred to the service tool assembly. By way of example, releasable mechanical anchor 64 can be expanded between the service tool assembly 34 and the surrounding casing 42. In many applications, the releasable mechanical anchor 64 can be positioned proximate an upper region of the service tool assembly 34, e.g. between the top of the service tool assembly and the surrounding casing or between the conveyance 55 and the surrounding casing. Thus, when weight is applied to conveyance 55, the forces are absorbed by releasable mechanical anchor 64 rather than being allowed to create buckling loads on service tool assembly 34. Accordingly, the anti-buckling mechanism 54 is able to limit the effects of buckling loads that otherwise could be experienced by the service tool assembly 34 during the gravel packing operation.

Releasable mechanical anchor 64 can have a variety of configurations and can be actuated by various mechanisms. For example, anchor 64 can be actuated mechanically or hydraulically. In one embodiment, the releasable mechanical anchor 64 comprises a packer used either with or without the packer sealing elements depending on the specific application. As with certain types of mechanically actuated packers, the releasable mechanical anchor 64 can be set by work string manipulation. In such an embodiment, the packer can be released by a straight pull (or other input) on the work string. In some applications, hold downs, such as hydraulic hold downs, can be used to provide additional anchoring in the up direction during pumping operations. Also, the releasable mechanical anchor 64 can comprise a hydraulically actuated packer.

Figure 4:
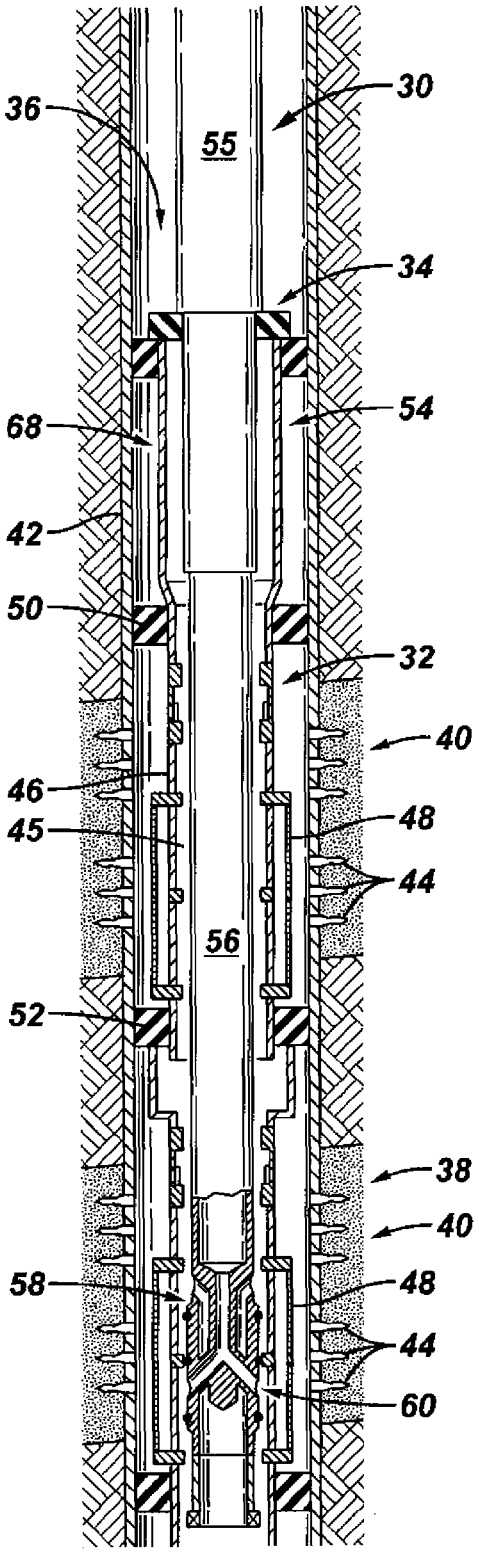
FIG. 4 is a schematic illustration of a service tool assembly and a completion assembly deployed in a wellbore with an alternate embodiment of the anti-buckling mechanism, according to another embodiment of the present invention.
Figure 5:
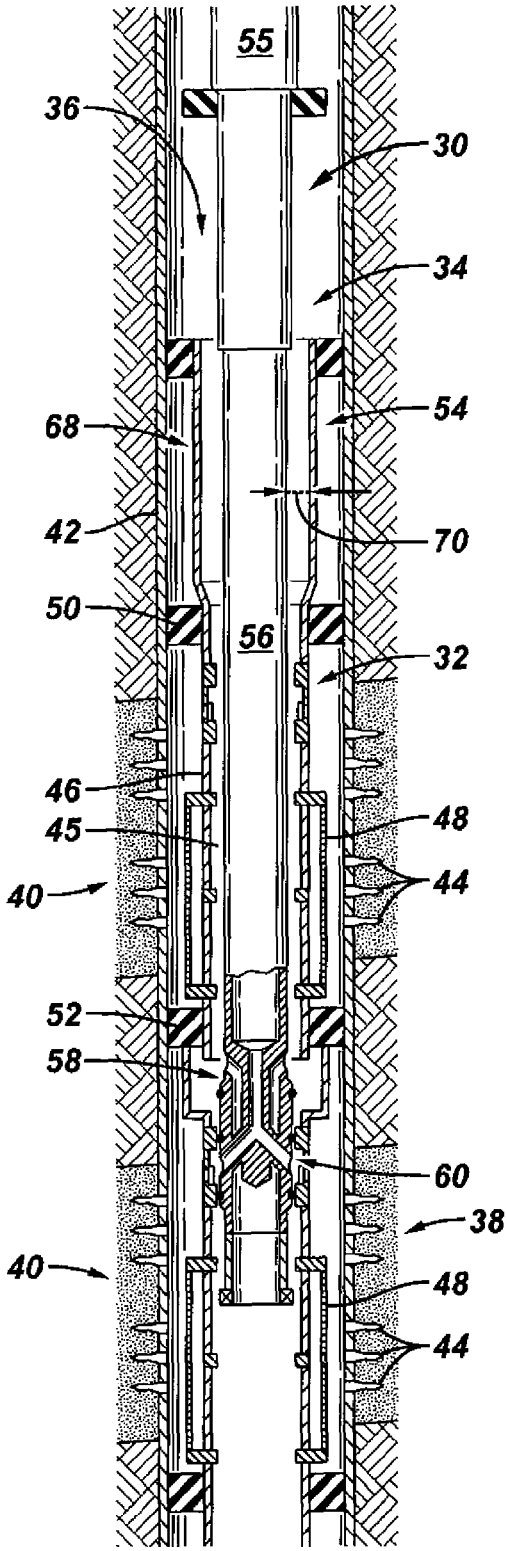
FIG. 5 is a schematic illustration similar to that of FIG. 4 but in a different operational configuration, according to an embodiment of the present invention.

In an alternate embodiment, anti-buckling mechanism 54 comprises a retrievable support string 68, as illustrated in FIGS. 4 and 5. In this embodiment, retrievable support string 68 is deployed downhole with the combined completion assembly 32 and service tool assembly 34, as illustrated best in FIG. 4. However, when service tool assembly 34 is released from completion assembly 32, retrievable support string 68 functions to reduce the radial clearance 70 surrounding the service tool assembly, as best illustrated in FIG. 5. The reduced radial clearance limits the space available for buckling and effectively supports the service tool assembly 34 against buckling. Thus, the anti-buckling mechanism 54 is again able to limit the buckling load effects that can otherwise be experienced by the service tool assembly during operation.

An example of a well treatment operation, e.g. gravel packing operation, is illustrated in FIGS. 6-11. In this example, a multi-zone, single trip sand control system is deployed and a multi-zone treatment operation is performed. An anti-buckling mechanism 54 is used to guard against detrimental effects that could otherwise occur due to buckling loads. The procedure can be used with a variety of system architectures, including isolation sliding sleeves or other mechanisms for controlling fluid flow with respect to each well zone.

Figure 6:
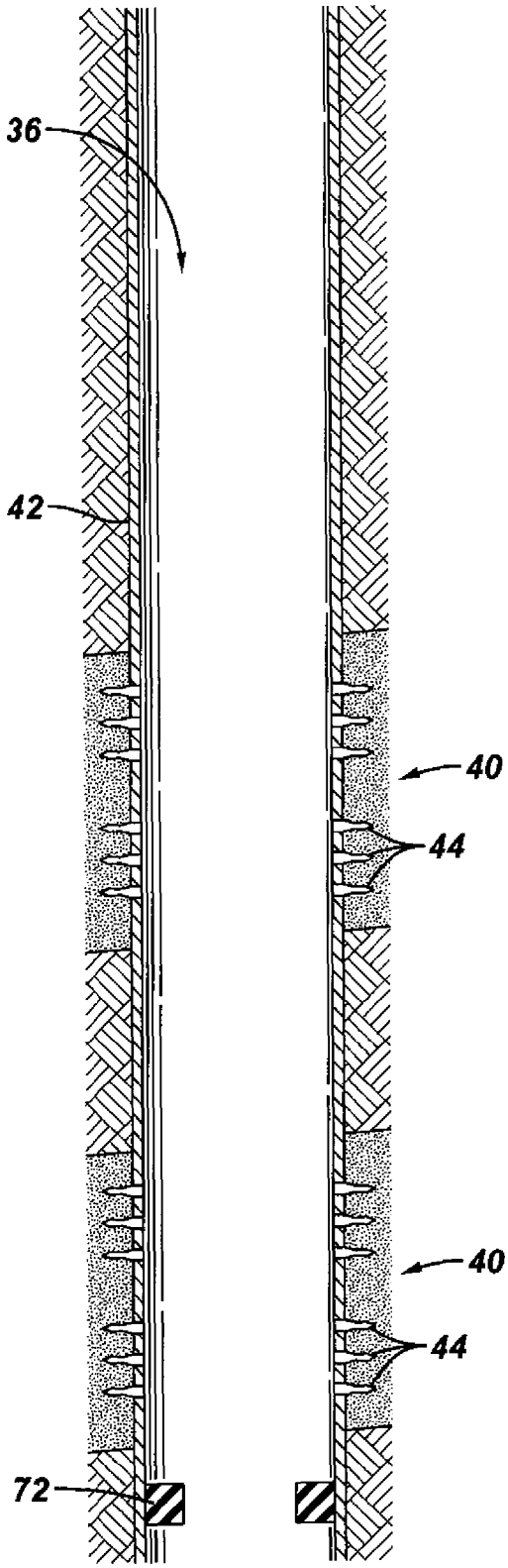
FIG. 6 is a schematic illustration of a wellbore into which the service tool assembly and completion assembly are to be deployed, according to an embodiment of the present invention.
Figure 7:
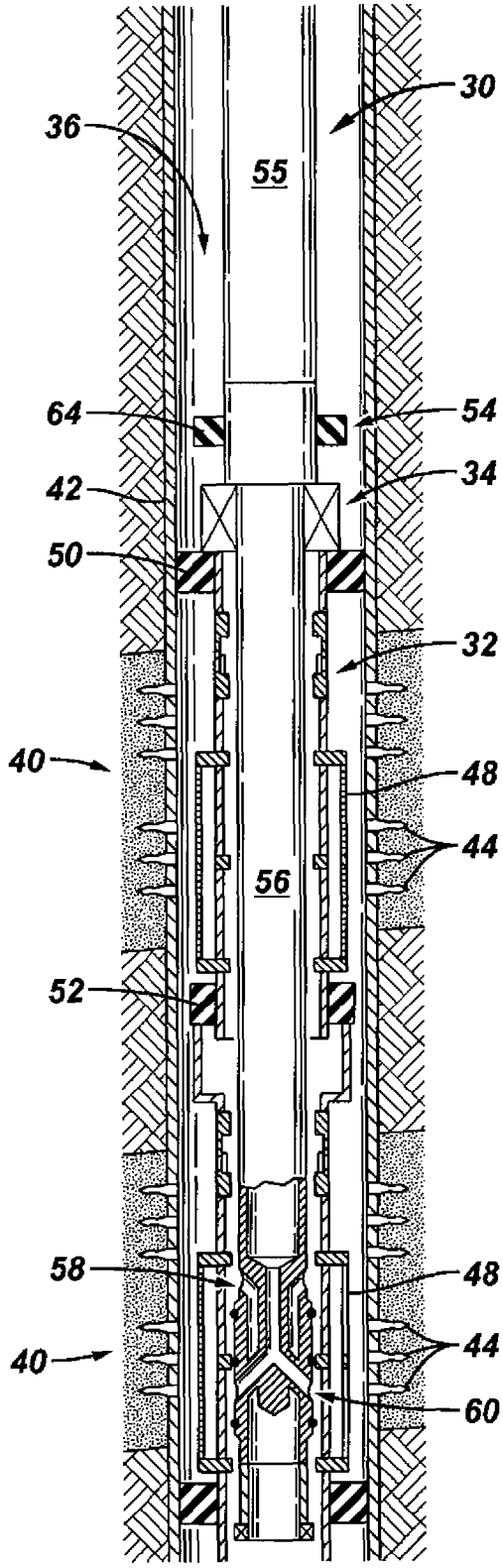
FIG. 7 is a schematic illustration of the service tool assembly and the completion assembly deployed into the wellbore illustrated in FIG. 6, according to an embodiment of the present invention.
Figure 8:
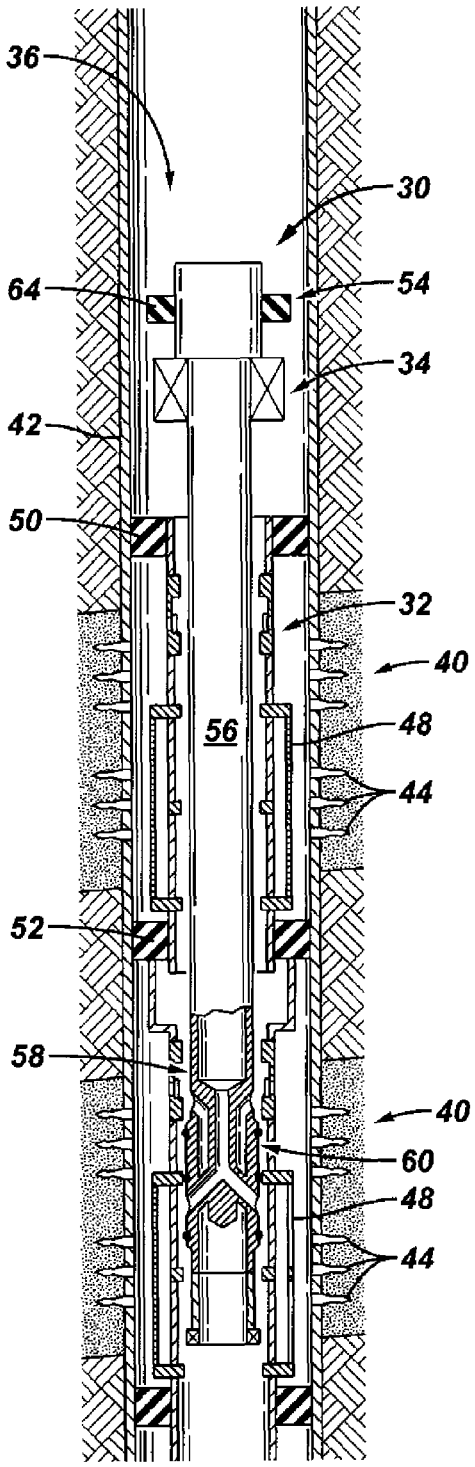
FIG. 8 is a schematic illustration similar to that of FIG. 7 but in a different operational configuration, according to an embodiment of the present invention.

As illustrated in FIG. 6, a packer 72, such as a sump packer, is initially set downhole and perforations 44 are formed in each well zone 40. The combined completion assembly 32 and service tool assembly 34 are then run-in-hole, as illustrated in FIG. 7. The gravel pack packer 50 is then set and service tool assembly 34 is released from the completion assembly 32. At this stage, service tool assembly 34 is moved relative to completion assembly 32 and positioned at a desired well zone 40, as illustrated in FIG. 8. The isolation packers 52 can then be set and, in some applications, tested to determine whether an adequate seal is formed to isolate the well zones.

Figure 9:
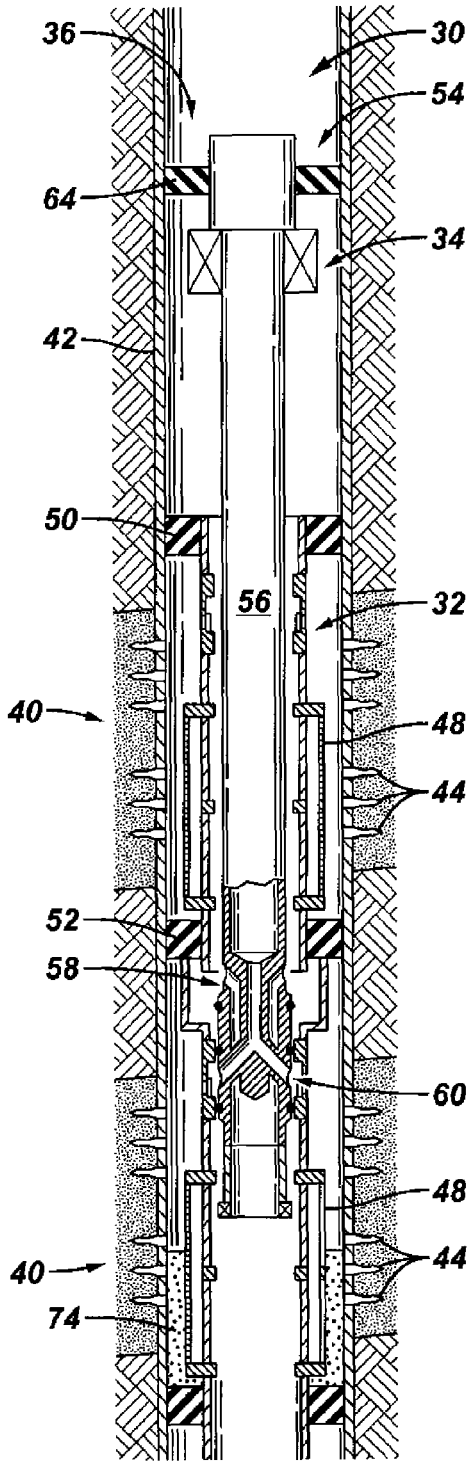
FIG. 9 is a schematic illustration similar to that of FIG. 8 but in a different operational configuration, according to an embodiment of the present invention.

The first well zone 40, which is often the lower well zone 40, can then be treated via a gravel packing procedure or other sand control treatment, as illustrated in FIG. 9. Initially, releasable mechanical anchor 64 is set against the surrounding casing 42 so that weight may be applied along conveyance 55 without inducing or threatening buckling of service tool assembly 34. By way of example, a gravel slurry is flowed down through service tool assembly 34 to crossover 60. The crossover 60 directs the gravel slurry outwardly through crossover ports 62, through corresponding ports in completion assembly 32, and into the well zone annulus surrounding the completion assembly. Gravel is deposited to create a sand control gravel pack 74 in the lower well zone 40, and the return fluids are directed up through service tool assembly 34 along return fluid flow paths.

Figure 10:
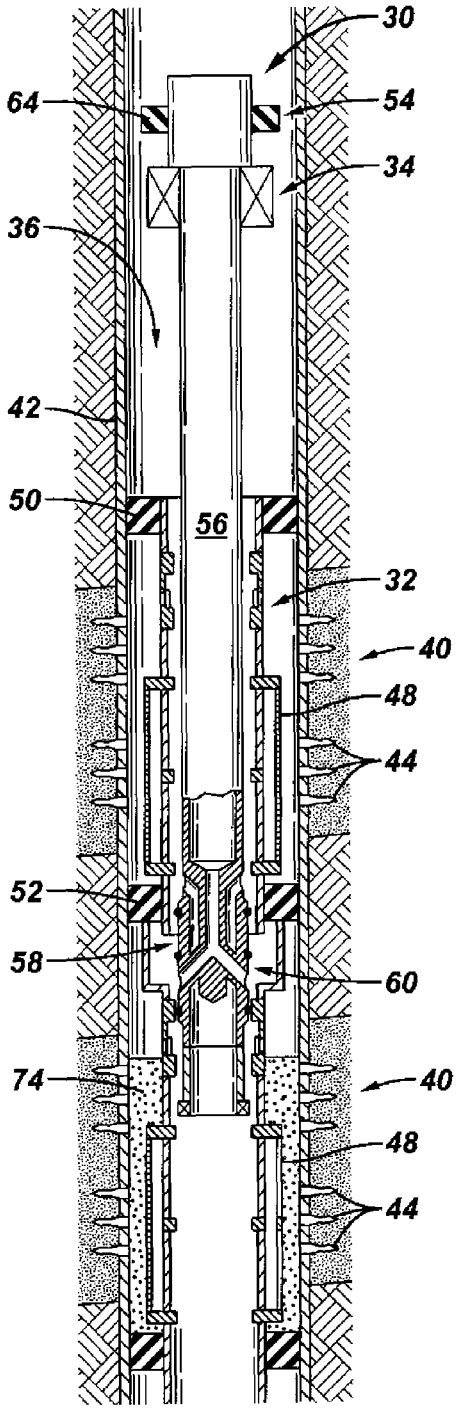
FIG. 10 is a schematic illustration similar to that of FIG. 9 but in a different operational configuration, according to an embodiment of the present invention.
Figure 11:
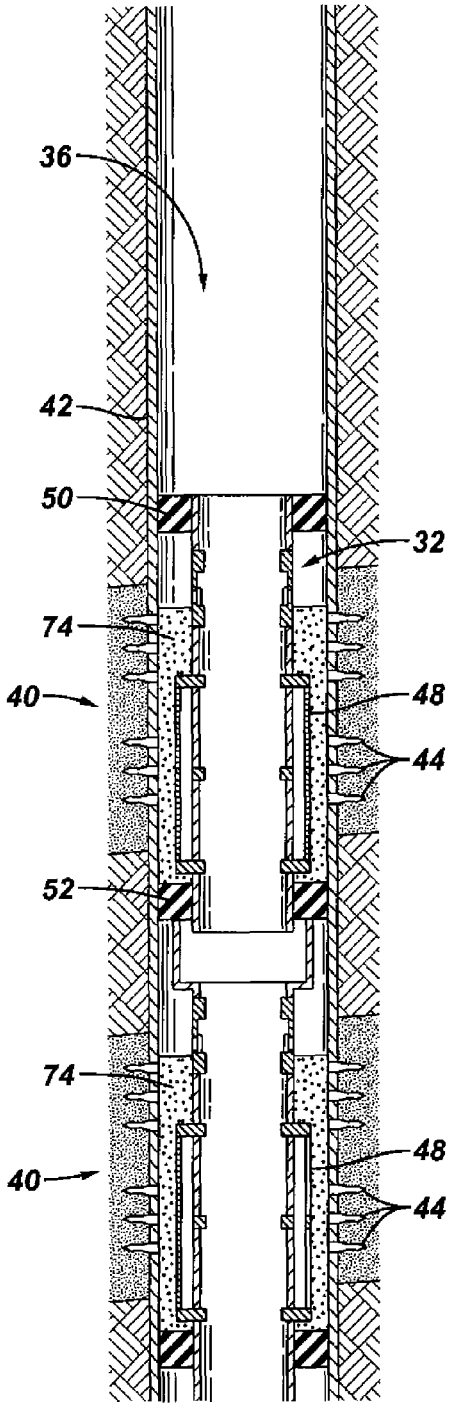
FIG. 11 is a schematic illustration similar to that of FIG. 10 but in a different operational configuration, according to an embodiment of the present invention.

After formation of gravel pack 74, the service tool 58 is shifted to a reverse flow configuration and releasable mechanical anchor 64 is disengaged from the surrounding casing 42, as illustrated in FIG. 10. The excess slurry is then reversed out to prepare the service tool assembly 34 for the treatment of a subsequent well zone. Once the excess slurry is cleared, the procedure described above is repeated at each subsequent well zone to provide similar control treatments at each zone. Upon completing treatment of each well zone, the service tool assembly 34 and anti-buckling mechanism 54 are withdrawn, as illustrated in FIG. 11.

Figure 12:
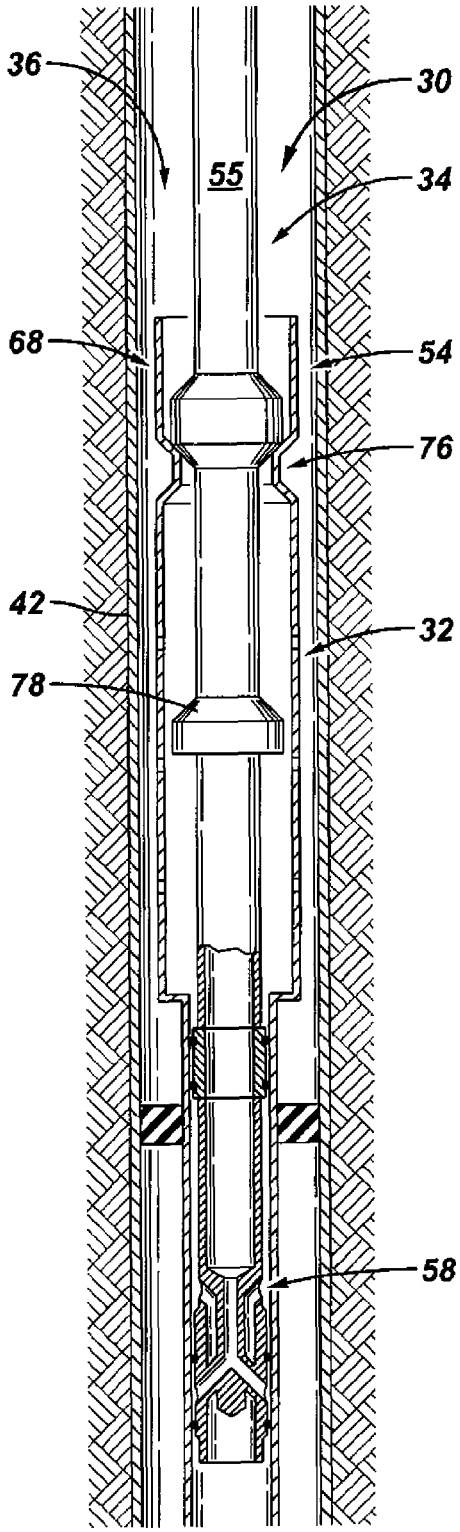
FIG. 12 is a schematic illustration of an alternate embodiment of the service tool assembly and completion assembly, according to another embodiment of the present invention.

In an alternate methodology, anti-buckling mechanism 54 comprises retrievable support string 68 which is deployed downhole with completion assembly 32 and service tool assembly 34, as illustrated in FIG. 12. If the well is a multi-zone well, a procedure similar to that described above with reference to FIGS. 6-11 can be employed to treat the multiple zones. In this latter embodiment, however, the potentially detrimental effects of buckling loads are limited by reducing the radial clearance surrounding the service tool assembly.

Figure 13:
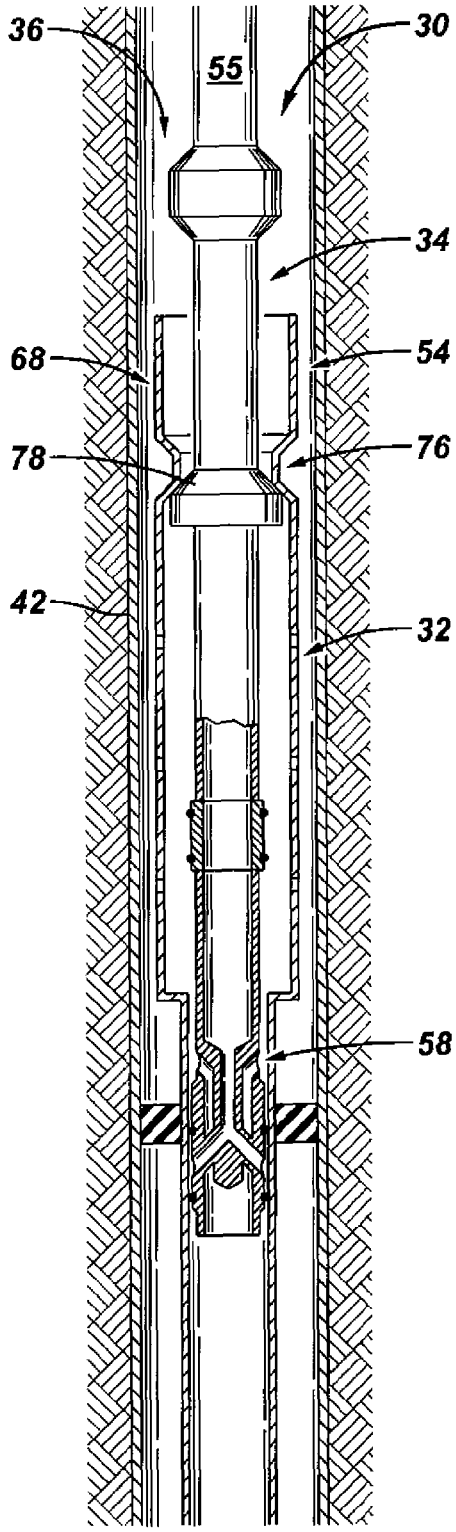
FIG. 13 is a schematic illustration similar to that of FIG. 12 but in a different operational configuration, according to an embodiment of the present invention.

The retrievable support string 68 may be run-in-hole with an appropriate pick-up collar 76. A corresponding shoulder 78 is mounted on service tool assembly 34 and positioned for engagement with pick-up collar 76. During sand control operations downhole, shoulder 78 does not engage pick-up collar 76. However, upon removal of service tool assembly 34, shoulder 78 engages pick-up collar 76, as illustrated in FIG. 13, and carries the retrievable support string 68 out of the well.

The embodiments described above provide examples of sand control treatment systems that are protected against detrimental buckling loads during sand control operations. The size, location, orientation and configuration of the anti-buckling mechanisms can vary from one well treatment application/environment to another. Also, depending on a given gravel packing operation, the configuration of the completion assembly and service tool assembly can be changed according to requirements of the job. Other components can be added, removed or interchanged to facilitate the well treatment operation. For example, a variety of valves, sliding sleeves, flow passages, crossovers and other components can be selected to facilitate a given well treatment operation. Additionally, the various embodiments described herein can be adapted for use in single zone or multi-zone applications in cased or open wellbores.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method, comprising:

locating a completion assembly downhole in a wellbore and setting the completion assembly with at least one packer to selectively isolate a well zone;

using a conveyance to position a service tool assembly in the set completion assembly in a gravel pack position for performing a gravel pack treatment on the isolated well zone, wherein a releasable anchor is positioned proximate an upper region of the service tool assembly;

after positioning the service tool assembly in the set completion assembly, setting the releasable anchor from a disengaged position into an engaged position when the service tool assembly is in the gravel pack position, wherein the releasable anchor is expanded to engage a wellbore wall so that forces are absorbed by the releasable anchor;

operating the service tool assembly in the gravel pack position with the releasable anchor in the engaged position to perform a gravel pack treatment on the isolated well zone; and disengaging the releasable anchor after the gravel pack treatment on the isolated well zone and withdrawing the service tool assembly and releasable anchor from the wellbore.

2. The method as recited in claim 1, wherein the releasable anchor is positioned on the conveyance to prevent buckling loads from reaching the service tool assembly, and wherein the releasable anchor is releasably set between the conveyance and a surrounding casing above the service tool assembly.

3. The method as recited in claim 2, wherein using the releasable anchor comprises using a packer mechanism.

4. The method as recited in claim 1, further comprising actuating the releasable anchor mechanically.

5. The method as recited in claim 1, further comprising actuating the releasable anchor hydraulically.

6. The method as recited in claim 1, wherein the releasable anchor is positioned on the service tool assembly above the completion assembly.

7. A method, comprising:

running a combined completion assembly and service tool assembly downhole into a wellbore on a service tool conveyance including a releasable anchor positioned proximate an upper region of the service tool assembly and in a disengaged position;

setting the completion assembly in the wellbore including setting a gravel packer;

setting at least one isolation packer to selectively isolate a first well zone and a second well zone;

moving the service tool assembly in the set completion assembly to position the service tool assembly in a first gravel pack position for performing a gravel pack treatment on the isolated first well zone;

setting the releasable anchor into an engaged position when the service tool assembly is positioned in the first gravel pack position to perform the gravel pack treatment on the isolated first well zone, wherein the releasable anchor is expanded to engage a wellbore wall so that forces are absorbed by the releasable anchor;

operating the service tool assembly in the first gravel pack position to perform the gravel pack treatment on the isolated first well zone with the releasable anchor in the engaged position;

positioning the releasable anchor into a disengaged position after the gravel pack treatment on the first zone and moving the service tool assembly in the set completion assembly to position the service tool assembly in a second gravel pack position for performing a gravel pack treatment on the isolated second well zone;

setting the releasable anchor into an engaged position when the service tool assembly is positioned in the second gravel pack position to perform the gravel pack treatment on the isolated second well zone, wherein the releasable anchor is expanded to engage a wellbore wall so that forces are absorbed by the releasable anchor; and operating the service tool assembly in the second gravel pack position to perform the gravel pack treatment on the isolated second well zone with the releasable anchor in the engaged position.

8. The method as recited in claim 7, wherein the releasable anchor engages a casing when in the engaged position.

9. The method as recited in claim 7, wherein the releasable anchor is positioned above the service tool assembly on the conveyance to prevent the buckling loads from reaching the service tool assembly.

10. The method as recited in claim 7, wherein the releasable anchor is positioned on the service tool assembly above the completion assembly.

11. The method as recited in claim 7, further comprising actuating the releasable anchor mechanically.

12. The method as recited in claim 7, further comprising actuating the releasable anchor hydraulically.

13. The method as recited in claim 7, further comprising disengaging the releasable anchor after the gravel pack treatments and withdrawing the service tool assembly and releasable anchor from the wellbore.

14. The method as recited in claim 7, wherein the completion assembly comprises a first screen assembly and a second screen assembly, and wherein the first screen assembly is disposed in the first well zone and the second screen assembly is disposed in the second well zone when the packers are set, and further comprising pumping gravel slurry through the service tool assembly, through crossover ports in the service tool assembly, and into a first screen assembly annulus and a second screen assembly annulus during a gravel pack treatment.

15. The method as recited in claim 7, wherein the at least one isolation packer is set after setting the releasable anchor.

16. A method, comprising:

running a completion assembly and service tool assembly downhole into a wellbore on a conveyance; wherein a releasable anchor is mounted proximate to a top of the service tool assembly;

setting the completion assembly in the wellbore to anchor the completion assembly in the wellbore;

setting at least one packer to selectively isolate a first well zone;

moving the service tool relative to the set completion assembly to position the service tool assembly in a first well treatment position in the well completion for performing a well zone treatment on the first well zone, wherein the well zone treatment comprises flowing treatment fluid from the service tool assembly into an annulus surrounding the completion assembly;

setting the releasable anchor into an engaged position when the service tool assembly is positioned in the first well treatment position; wherein when in the engaged position the releasable anchor is secured in the wellbore to prevent buckling of the service tool assembly during the well zone treatment; and operating the service tool assembly in the first well treatment position to perform the well zone treatment on the first well zone with the releasable anchor in the engaged position.

17. The method as recited in claim 16, wherein the releasable anchor is positioned on the conveyance to prevent buckling loads from reaching the service tool assembly, and wherein the releasable anchor is a packer mechanism releasably set between the conveyance and a surrounding casing above the service tool assembly.

18. The method as recited in claim 16, further comprising:

positioning the releasable anchor into a disengaged position after the well treatment on the first zone;

moving the service tool assembly relative to the completion assembly to position the service tool assembly in a second well treatment position in the completion assembly for performing a well zone treatment on a second well zone;

setting the releasable anchor into an engaged position when the service tool assembly is positioned in the second well treatment position; and operating the service tool assembly in the second well treatment position to perform the well zone treatment on the second well zone with the releasable anchor in the engaged position.

19. The method as recited in claim 16, wherein the well zone treatment is a gravel pack treatment.

20. The method as recited in claim 16, further comprising running the completion assembly and service tool assembly together downhole into a wellbore on a conveyance, and releasing the service tool assembly from the set completion assembly.

* * * * *